United States Patent [19]

Wainer et al.

[11] 3,986,880

[45] Oct. 19, 1976

[54] FREE RADICAL PHOTOSENSITIVE MATERIALS

[75] Inventors: Eugene Wainer, Shaker Heights; John E. Shirey, Bedford Heights; Lothar Ramins, Middlefield, all of Ohio

[73] Assignee: Horizons Incorporated a division of Horizons Research Incorporated, Cleveland, Ohio

[22] Filed: Aug. 23, 1974

[21] Appl. No.: 500,117

[52] U.S. Cl. ..... 96/90 R; 96/90 PC

[51] Int. Cl.[2] ..... G03C 1/52

[58] Field of Search ..... 96/90 R, 89, 90 PC

[56] References Cited

UNITED STATES PATENTS

| | | | |
|---|---|---|---|
| 3,056,673 | 10/1962 | Wainer | 96/90 R |
| 3,102,029 | 8/1963 | Fichter et al. | 96/90 R |
| 3,102,810 | 9/1963 | Sprague et al. | 96/90 R |
| 3,123,473 | 3/1964 | Agruss | 96/90 R |
| 3,202,507 | 8/1965 | Sprague et al. | 96/90 R |
| 3,563,750 | 2/1971 | Walker | 96/90 R |
| 3,708,297 | 1/1973 | Poot et al. | 96/90 R |
| 3,773,515 | 11/1973 | Yamashita et al. | 96/90 R |

*Primary Examiner*—Won H. Louie, Jr.
*Attorney, Agent, or Firm*—Lawrence I. Field

[57] ABSTRACT

The keeping qualities (shelf life), and photographic speed of non-silver free radical photosensitive materials are increased by the incorporation of at least one of each of three classes of additives, namely:

(1) a stabilizer, usually an alcohol or a phenol;
(2) a speed enhancer; and
(3) a compound which enhances the capability of heat fixing of films containing both (1) and (2).

11 Claims, No Drawings

FREE RADICAL PHOTOSENSITIVE MATERIALS

The invention is an improvement over the compositions originally disclosed in Wainer, U.S. Pat. No. 3,042,515 and in later inventions including U.S. Pat. Nos. 3,481,739 issued Dec. 2, 1969; 3,510,309 issued May 5, 1970; 3,533,792 issued Oct. 13, 1970; 3,660,096 issued May 2, 1972; and 3,697,272 issued Oct. 10, 1972 to Eugene Wainer and others working with him.

In non-silver photosensitive materials of the type described in U.S. Pat. No. 3,102,810 and others in which the compositions comprise an aryl amine and an organic halogen compound which produces free radicals when exposed to a suitable dose of radiation and thereby produce a color or change in color in the amine, one of the problems which has prevented a more widespread commercialization of films containing the compositions has been the relatively short shelf life of the compositions.

While not wishing to be bound to any specific explanation, it appears that this phenomenon may be due in part to the tendency of $CBr_4$ or $CHI_3$ or other halomethanes to evaporate from the composition almost as soon as it has been prepared, or to crystallize or assume a form in which they are less effective in the film.

As a consequence it has been the practice to store such film under refrigeration, and it has also been suggested that the film be stored in an atmosphere saturated with the free radical source, so that it is continuously available to the film, up to the time of actual use.

The present invention is directed to improving the shelf life of such non-silver photosensitive compositions so that they can be stored in the dark without refrigeration or other special measures, and which, if stored under refrigeration exhibit an almost unlimited effective life.

These and other improvements are obtained by the incorporation of three essential constituents into otherwise known photosensitive compositions.

Although the present invention is applicable to virtually all of the compositions described in the below noted publications and patents, it is particularly suited to those described in U.S. Pat. Nos. 3,102,810; U.S. 3,481,739 issued Dec. 21, 1969 and those described in U.S. Pat. No. 3,510,304 issued May 5, 1970, and in the examples which follow it will be illustrated with reference to such compositions.

Publications

Photographic Science and Engineering, vol. 5, No. 2, March-April 1961, pp. 98–103.

Photographic Science and Engineering, vol. 8, No. 2, March-April 1964, pp. 91–95.

Photographic Science and Engineering, vol. 8, No. 2, March-April 1964, pp. 95–103.

Photographic Science and Engineering, vol. 9, No. 2, March-April 1965, pp. 133–137.

| United States Patents | | | |
|---|---|---|---|
| 3,042,515 | 3,082,086 | 3,109,736 | 3,147,117 |
| 3,042,516 | 3,095,303 | 3,112,200 | 3,155,509 |
| 3,042,517 | 3,100,703 | 3,113,024 | 3,154,416 |
| 3,042,518 | 3,102,027 | 3,114,635 | 3,164,467 |
| 3,042,519 | 3,102,029 | 3,121,632 | 3,202,507 |
| 3,046,125 | 3,102,810 | 3,121,633 | 3,272,635 |
| 3,046,209 | 3,104,973 | 3,140,948 | 3,275,443 |

-continued

| United States Patents | | | |
|---|---|---|---|
| 3,056,673 | 3,106,466 | 3,140,949 | 3,285,744 |

and other more recently issued patents.

Briefly the invention comprises the incorporation of stated amounts of each of three constituents into the prior art non-silver free radical photosensitive compositions which consist essentially of (1) a color changing compound, usually an aryl amine as defined in U.S. Pat. No. 3,042,515 issued July 3, 1962; and (2) a source of free radicals, usually an organic halogen compound as defined in U.S. Pat. No. 3,042,515 or an organic sulfur containing compound as defined in U.S. Pat. No. 3,342,595 issued Sept. 19, 1967, together with various optional constituents such as are defined in U.S. Pat. No. 3,042,515.

The three additional constituents to be incorporated in the otherwise known compositions may be defined as follows:

1. Organic compounds with one or more hydroxyl groups including aliphatic alcohols, both monohydric and polyhydric alcohols, aromatic compounds such as polyhydroxybenzenes; the only limitations on the suitability of the compounds being that they are required to be solids at ordinary room temperatures. Lower alcohols such as methanol or ethanol, and phenol itself, cannot be used, nor can compounds which are vapors at ordinary atmospheric pressure and temperature. Compounds which are suitable appear to act as stabilizers and exhibit the property of increasing shelf life to some extent when present without either of the other essential additives but the presence of both of the other constituents is required in order to obtain the full benefits of this invention.

2. Plasticizers selected from the group consisting of plasticizers for polystyrene and/or acrylic ester resins. Preferred plasticizers are defined below.

3. Triarylcarbinols such as triphenylcarbinol (preferred) and similar carbinols. Although in a formal sense these are organic compounds containing an -OH group, they differ from those defined in 1 (above) in that the latter have no noticeable effect on the photographic speed of the compositions, when present in the composition without the plasticizer and carbinol, whereas the carbinols do have such an effect, but exhibit it to a markedly less degree in the absence of the -OH compound and the plasticizer, than in their presence.

Preferred additives are defined in the paragraphs which follow.

1. Alcohol or Phenol.

Suitable alcohols include higher alcohols such as cetyl alcohol, 1-phenyl-1-cyclohexanol, and other alcohols which are compatible with the remaining constituents in the photosensitive composition and which are solids at room temperature.

Phenols which have been found suitable include $\beta$-naphthol, m-nitrophenol, resorcinol, 4-t-butylcatechol, 4-methyl thiophenol, propyl gallate, and other similar diol or triol compounds.

Still other hydroxy compounds which have been found suitable, in addition to those described above or in the examples which follow include benzhydrol; 8-hydroxyquinoline; 2-quinolinol; 2,4-dihydroxybenzophenone; 2′,3′,4′-trihydroxyacetophenone; 1,4-cyclohexanedimethanol; 2,5-dimethyl-3-hexyne2,5-diol; 4,4′-isopropylidene dicyclohexanol; 2,5-dihydroxynaphthaline; 2,3-dihydroxypyridine; and pinacol.

2. Plasticizer

Plasticizers which have been utilized include: trialkyl and triarylphosphates such as tri-(butoxyethyl)-, tri-(2,3-dibromopropyl)-, triphenyl-, or tricresyl-phosphate, and similar phosphates; various phthalates such as dibutylphthalate, di-2-ethylhexylphthalate and dioctylphthalate; sulfonamides, e.g., p-toluenesulfonamide; and metal salts of such plasticizers including e.g., zinc or cadmium-diisopropylidithiophosphates, methyl oleate, and phenyl-2-hydroxy-3-naphthoate.

3. Speed Enhancer

The third essential constituent to be added to form the compositions of this invention comprises a compound or compounds which increases the speed of the composition without adversely affecting other photographic properties, and which appears to have this effect increased by the presence of both the organic hydroxy compound and the plasticizer. One such compound, particularly preferred in the practice of this invention is triphenylcarbinol.

4. Other Constituents

The other essential constituents of the photosensitive compositions of this invention will be readily apparent from the prior art noted above and from the examples which follow in which preferred embodiments of the invention are set forth and include the following:

A. Aryl amines represented by the formula

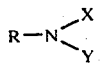

in which R represents an aryl nucleus such as phenyl, naphthyl or anthracyl, which may be either unsubstituted or substituted e.g., with alkyl, halogen or other groups or R may represent a heterocyclic nucleus such as xanthyl, quinolyl, or other heterocyclic nucleus which includes one or more atoms of O, S, Se or N or other atoms in addition to the carbon atoms necessary to complete the ring, and X and Y are each selected from the group consisting of alkyl, aryl, arylalkyl, or other substituents and may be the same or different as described in U.S. Pat. No. 3,042,515 issued July 3, 1962. Particularly preferred arylamines are those described in U.S. Pat. Nos. 3,510,304 issued May 5, 1970 and 3,712,817 issued Jan. 12, 1973.

B. Organic halogen compounds or other know activators describe in any of the above patents. The organic halogen compounds are those in which at least three halogen (Cl, Br or I) atoms are attached to a single carbon atom, or they may be sulfur containing compounds as described in U.S. Pat. No. 3,342,595 issued Sept. 19, 1967.

C. Optional Contituents

Other additives utilized to provide various benefits may also be added to the composition for the purposes described in the above and other prior art without departing from the intended scope of this invention.

The following examples are intended to illustrate the practice of this invention and are not intended to limit the same in any way.

EXAMPLE 1

A photosensitive mixture was prepared by dissolving the following in a binder mixture comprised of 4 ml of polystyrene solution (27 g in 100 ml of toluene) 1 ml of polyphenylene oxide (18 g in 100 ml of trichloroethylene) and 2 ml of 1,2-dichloroethane:

26 mg of triphenylamine
16 mg of triphenylstibine
64 mg of triethylamine
80 mg of 1,1-bis-(p-dimethylaminophenyl)ethylene
360 mg of iodoform
12 mg of 4 aminoantipyrene
12 mg of acetanilide
24 mg of 4-phenyl-pyridine-N-oxide
2 mg of N-vinylcarbazole
5 mg of 3,6 diisopropylcatechol
10 mg of triphenylphosphate
75 mg of triphenylcarbinol The resulting formulation was coated 0.003 inch wet thickness on a sheet of polyethylene terephthalate and then dried for two minutes at 90° C. The film was then exposed to a high pressure mercury arc lamp and then fixed by heating for two minutes at 160° C.

After preparation, exposure and fixing, the fresh film had a speed of 98 mj for net D-1.0, with a base plus fog density of 0.04 and a gamma of 2.3. After storage for 8 weeks at room conditions this same film exhibited a speed of 87 mj, a base + fog density of 0.05 and a gamma of 2.0. As a control, an otherwise similar film was prepared in which the three constituents of the present invention were replaced with 53 mg of 2,6-di-tert-butyl-cresol. The resulting film was treated in the same manner as above, and exhibited a speed for net D = 1.0 of 165 mj with a base plus fog density of 0.04 and a gamma of 1.6. After storage for 8 weeks at room conditions this same film exhibited a speed of 220 mj, a base plus fog density of 0.20 and a gamma of 1.0.

From the above it will be seen that the formulation of Example 1 exhibited improved shelf life as compared with the control. Two other improvements were realized by using the combination constituting the present invention; namely:

1. The speed was substantially improved over that of the control formulation. This is due principally to the addition of triphenylcarbinol. The speed of a film with only the addition of 3,6-diisopropylcatechol and triphenylphosphate is approximately 150 ml;

2. The film fixes faster. The control formulation is not completely fixed even after 2 minutes of heating at 160° C, and if only heated one minute at 160° C will fog or reexposure. For example, if the control formulation is only fixed for one minute at 160° C and then exposed to a G.E. sunlamp for 10 minutes at a distance of 18 inches, the base plus fog density will build up to 0.15. The formulation of this example on the other hand exhibited a base plus fog density of only 0.07 after the same treatment. None of the three components by themselves can cause this faster fixation.

The concentrations of the three ingredients are not limited to those given in Example No. 1 and the following ranges are of practical value:

| | |
|---|---|
| 3,6-diisopropylcatechol | 5–25 mg |

-continued

| | |
|---|---|
| Triphenylphosphate | 5–50 mg |
| Triphenylcarbinol | 5–100 mg |

The amounts used in the composition of Example No. 1 are the preferred ones.

EXAMPLE NOS. 2–22

The effect of other constituents, used in place of those used in Example 1 is shown in Tables I, II and III which follow.

Table I

Effect of Other Stabilizers in the Composition of Example 1

| Example No. | Stabilizer | Speed(Mj) | B+F | Gamma | Base plus Fog After Fix Test |
|---|---|---|---|---|---|
| 2 | 4-t-butylcatechol | 62 | .04 | 2.3 | .05 |
| 3 | 3,5-di-t-butylcatechol | 87 | .04 | 1.9 | .08 |
| 4 | 2,5-di-t-butylhydroquinone | 71 | .06 | 1.8 | .08 |
| 5 | 1,2,4-benzenetriol | 60 | .06 | 2.2 | .07 |

The fix test refers to that described in Example No. 1. All of the examples show no significant change in film characteristics on storage at room conditions for at least 8 weeks.

Table II

Effect of Various Plasticizers Substituted for Triphenylphosphate in Example No. 1

| Example No. | Plasticizer Used | Fresh Film Speed | Fresh Film B+F | Fresh Film Gamma | After 8 Weeks Speed | After 8 Weeks B+F | After 8 Weeks Gamma |
|---|---|---|---|---|---|---|---|
| 6 | Dibutylphthalate | 55 | .04 | 2.2 | 65 | .08 | 1.8 |
| 7 | Di-2-ethylhexylphosphate | 70 | .04 | 1.9 | 85 | .08 | 1.6 |
| 8 | Tris-(2,3-dibromopropyl-phosphate | 59 | .04 | 2.1 | 43 | .06 | 1.5 |
| 9 | p-toluenesulfonamide | 60 | .04 | 2.7 | 60 | .06 | 2.0 |

Table III

Effect of Other Hydroxy Compounds in the Composition of Example 1

| Ex. No. | Plasticizer | Hydroxy Compound | Speed | B+F | Gamma | B+F After Fix Test |
|---|---|---|---|---|---|---|
| 10 | Tri(butoxyethyl)phosphate | 2-Quinolinol | 70 | .04 | 1.5 | .05 |
| 11 | Triphenylphosphate | 2′,3′,4′-trihydroxy-acetophenone | 62 | .04 | 1.6 | .06 |
| 12 | Triphenylphosphate | 2,5-dimethyl-3-hexyne 2,5-diol | 70 | .04 | 1.5 | .06 |
| 13 | Triphenylphosphate | 4,4′-Isopropylidene-dicyclohexanol | 70 | .04 | 1.3 | .05 |
| 14 | Triphenylphosphate | Pinacol | 75 | .04 | 1.3 | .06 |
| 15 | Methyl Oleate | 4-t-butyl catechol | 75 | .04 | 1.4 | .06 |
| 16 | Triphenylphosphate | 8-hydroxyquinoline | 57 | .04 | 1.7 | .06 |
| 17 | Triphenylphosphate | Benzhydrol | 45 | .04 | 1.5 | .05 |
| 18 | Dioctylphthalate | 2,4-Dihydroxybenzophenone | 56 | .04 | 1.6 | .06 |
| 19 | Triphenylphosphate | 1,4-Cyclohexane-dimethanol | 49 | .04 | 1.6 | .06 |
| 20 | Phenyl-2-hydroxy-3-naphthoate | 2,5-dihydroxy-naphthaline | 60 | .04 | 1.8 | .07 |
| 21 | Triphenylphosphate | 2,5-dihydroxy-pyridine | 49 | .04 | 1.7 | .08 |
| 22 | Dibutylphthalate | 1,1,1-Tris(hydroxy-methyl)ethane | 66 | .04 | 1.6 | .04 |

EXAMPLE NO. 23

A binder solution was prepared by dissolving 27 g. of polystyrene in 100 ml of toluene. Four milliliters of this solution were combined with 2 ml of acetone. To this mixture was added 100 mg leuco crystal violet, 20 mg 4-(p-dimethylaminostyryl)-quinoline, 10 mg picoline-N-oxide, 10 mg 1,2,4-benzenetriol, 10 mg triphenylphosphate, 25 mg triphenylcarbinol and 1.0 g of carbon tetrabromide. The resulting solution was coated at .0015 inch thick (wet) on a sheet of polyethylene terephthalate and then airdried for 2 seconds. Optical development was then accomplished by blanket exposure of the film to radiation from a tungsten iodine lamp filtered to cut off all light below 622 nanometers. The resultant optically developed film was fixed by solvent washing in a mixture of 1 part of acetone to 4 parts of petroleum ether. A speed of 0.5 mj for net D=0.3 was obtained. After storage at room temperature for a period of one day the same film had lost no speed. A similar film witout the triphenylphosphate, triphenyl carbinol and 1,2,4-benzene triol lost speed by a factor of 1000.

The film of this Example also had the capability of being heat fixed. If the film was heated for one minute at 160° C after optical development, a speed of 0.3 mj at net D=0.3 was obtained with a base plus fog density of 0.17. The same film solvent fixed had a base plus fog density of 0.15. Omission of the three added ingredients results in a film which fogs to 1.70 during the same heat fixing step.

The addition of the benzene triol, triphenylphosphate and triphenyl carbinol imparted improved speed and longer shelf life to the composition. A film such as that of Example No. 23 containing only the addition of 1,2,4-benzenetriol has much better shelf life than a similar film without it. The addition of all three constituents improves the shelf life by a factor of two over a film containing only the triol addition. The combined ingredients film also has a speed of at least double that of the single triol additive film. Thus the combination of the three ingredients provides improved shelf life, greater speed and ability to heat fix. None of the three ingredients can accomplish all three improvements by themselves.

EXAMPLE NOS. 24-34

Table IV lists other Examples of diols and triols used in place of 1,2,4-benzenetriol used in Example 23. The amounts of triphenylphosphate and triphenylcarbinol were kept the same as in Example No. 23. In all cases the loss in speed was considerably less than the speed loss experienced by a formulation that did not contain the unique combination of ingredients. All of the films shown in Table IV were stored at room conditions for a period of one day.

Table IV

Effect of Other Diols and Triols in the Formulation of Example No. 23

| Example No. | Diol or Triol Used | Speed Loss Factor |
|---|---|---|
| 24 | None | 1000 |
| 25 | Catechol | 11 |
| 26 | Resorcinol | 1 |
| 27 | Hydroquinone | 1.5 |
| 28 | 4-methylcatechol | 4 |
| 29 | 4-5-butylcatechol | 8 |
| 30 | 2,5-di-t-butyl hydroquinone | 2 |
| 31 | 3-methoxylcatechol | 4 |
| 32 | Pyrogallol | 1 |
| 33 | 2',3',4'-Trihydroxyacetophenone | 5 |
| 34 | Propyl gallate | 4 |

EXAMPLE NO. 35

To a binder solution described in Example 23, there was added 100 mg leuco malachite green, 20 mg 4-(p-diethylaminostyrl)quinoline, 20 mg picoline-N-oxide, 10 mg pyrogallol, 10 mg triphenylphosphate, 25 mg triphenylcarbinol and 1.0 g carbon tetrabromide. The resulting solution was coated, dried, exposed, optically developed and fixed as in Example 23 and resulted in a speed of 1.3 mj with a base plus fog density of 0.04. Heat fixation of this same film for one minute at 160° C resulted in a speed of 1.0 mj and a base plus fog density of 0.08. Storage at room temperature for a period of one day resulted in a speed loss of 2. A similar film without the three additional ingredients exhibited a speed loss of 700 and when heat fixed fogged to 0.50.

EXAMPLE NO. 36

To a binder solution as described in Example 23 was added 25 mg 2,7-bis(dimethylamino)-10-p-dimethylamino-9,-9-dimethyl-9,10-dihydroanthracene, 20 mg 4-(p-dimethylaminostyrl)-quinoline, 10 mg picoline-N-oxide, 10 mg 1,2,4-benzenetriol, 10 mg triphenylphosphate, 25 mg triphenylcarbinol and 1.0 g carbon tetrabromide. The resulting solution was coated, dried, exposed, optically developed and fixed as in Example 23 and resulted in a speed of 1.4 mj with a base plus fog density of 0.16. Heat fixation of this same film for one minute at 160° C resulted in a speed of 1.0 mj, with a base plus fog density of 0.14.

Storage at room temperature for a period of one day resulted in a speed loss of 4. A similar film without the three additional ingredients exhibited a speed loss of 2000 and when heat fixed fogged to 1.08.

EXAMPLE NO. 37

A film similar to that of Example 23 was prepared using the following ingredients: 100 mg leuco opal blue, 20 mg 4-(p-dimethylaminostyryl)-quinoline, 10 mg picoline-N-oxide, 10 mg 1,2,4-benzenetriol, 10 mg dibutylphthalate, 25 mg triphenylcarbinol and 1.0 g carbon tetrabromide. The resultant film was treated in exactly the same fashion as in Example 23 and yielded a speed at net D=0.3 of 2.5 mj with a base plus fog density of 0.08. Storage at room conditions for one day resulted in a speed loss of only 3 whereas a similar film without 1,2,4-benzenetriol, triphenylcarbinol and dibutylphthalate lost speed by a factor of 500 during the same one day period.

EXAMPLE NO. 38

A film similar to that of Example 32 was prepared except that 5 mg of crystal violet carbinol was used in place of the triphenylcarbinol. The resultant film behaved in a similar fashion as that described in Example 23.

EXAMPLE NO. 39

A binder solution was prepared by dissolving 27 g of an acrylic ester resin (Acryloid A-11, Rohm & Haas Co.) in 100 ml of toluene. To a mixture of 4 ml of this binder solution and 2 ml of acetone was added 100 mg leuco crystal violet, 20 mg 4-(p-dimethylaminostyryl)-quinoline, 10 mg 4-picoline-N-oxide, 10 mg pyrogallol, 10 mg triphenylphosphate, 25 mg triphenylcarbinol and 1.0 g carbon tetrabromide. The resulting solution was coated 0.0015 inch thick (wet) on a sheet of polyethylene terephthalate and then air-dried for 5 minutes. This film was exposed to a high pressure mercury arc lamp for 2 seconds. Optical development was then performed by blanket exposure of the film to radiation from a tungsten iodine lamp filtered to cut off all light below 645 nm. The resultant developed film was fixed by solvent washing in a mixture of 1 part acetone to 4 parts petroleum ether. A speed of approximately 1 mj at net D=0.3 was obtained. After storage at room temperature for a period of one day the same film lost speed by a factor of 3. A similar film with no pyrogallol, no triphenylphosphate and no triphenylcarbinol lost speed by a factor of 100. Addition of only triphenylphosphate resulted in a speed loss of 350. Addition of only triphenylcarbinol gave a speed loss of 115. A combination of triphenylphosphate and triphenylcarbinol resulted in a speed loss of 45. Addition of only the pyrogallol resulted in a speed loss of 6. Thus only the combination of the three ingredients resulted in the lowest loss in speed. As in the case of Example 23, the film containing a combination of all three could be heat fixed without appreciable fog buildup.

EXAMPLE NOS. 40–45

Table V lists other examples of diols and triols substituted for the pyrogallol used in Example 39. The amounts of the triphenylphosphate and triphenylcarbinol remained the same as in Example 39. In all cases, the loss in speed was considerably less than the speed loss of a formulation which did not contain the combination of all three ingredients.

Table V

Effect of Other Diols and Triols in the Formulation of Example 40

| Example No. | Diol or Triol Used | Speed Loss Factor |
|---|---|---|
| 40 | None | 100 |
| 41 | 1,2,4-benzenetriol | 2 |
| 42 | 2,5-di-t-butylhydroquinone | 7 |
| 43 | 4-methylcatechol | 5 |
| 44 | Hydroquinone | 6 |

Table V-continued

| Effect of Other Diols and Triols in the Formulation of Example 40 | | |
|---|---|---|
| Example No. | Diol or Triol Used | Speed Loss Factor |
| 45 | Propyl gallate | 5 |

EXAMPLE NO. 46

A film was prepared in exactly the same fashion as in Example 23 except that air drying was extended to 10 minutes. The resulting film was overcoated with 3½% polyvinyl alcohol solution in water at 0.0005 inch wet thickness and then allowed to air dry for 10 minutes. The overcoated film was fixed by first mechanically stripping the polyvinyl alcohol layer and then either solvent washing or heat fixing the resulting film in the manner described previously. The film had a speed of approximately 0.1 mj for net D=0.3 with a base plus fog density of 0.16. The data given is for the solvent fixed film. After storage at room conditions for two weeks the same film lost speed by a factor of 4 and had a base plus fog density of 0.14. A similar film without the addition of the three ingredients lost speed by a factor of 35 and had a base plus fog density of 0.70 after storage for two weeks at room conditions.

EXAMPLE NO. 47

A film similar to that described in Example 46 was prepared except that pyrogallol was substituted for the 1,2,4-benzenetriol. Two weeks storage at room conditions resulted in a speed loss factor of 5.

EXAMPLE NO. 48

A film was prepared in exactly the same fashion as in Example 23 except that the film was overcoated with polyvinyl alcohol as described in Example 46. After exposure, development and fixing the film exhibited a speed of approximately 0.3 mj for net D=0.3 with a base plus fog density of 0.12. after storage for two weeks at room conditions the same film lost speed by a factor of 10 with little change in base plus fog. A similar film without the addition of the three ingredients lost speed by a factor of 20 and had a base plus fog density of 0.84.

EXAMPLE NO. 49

A film similar to that described in Example 48 was prepared except that 1,2,4-benzenetriol was substituted for the pyrogallol. Two weeks storage at room conditions resulted in no change.

We claim:

1. In a non-silver photosensitive composition consisting essentially of:

at least one activator compound which releases free radicals when exposed to a suitable dose of radiation and which is selected from the group consisting of organic compounds which contain at least two chlorine, bromine or iodine atoms, organic compounds which contain a mercapto —SH group, and organic compounds which contain both halogen and sulfur;

and at least one leuco dye which prints out a visible image when in the presence of free radicals said activator compound and said leuco dye being carried in a film forming resin binder;

the improvement which comprises providing said composition with the following three additional constituents;

1. at least one aromatic -OH compound which is solid at room temperature and which is selected from the group consisting of polyhydric alcohols and polyhydric phenols;
2. at least one plasticizer selected from the group consisting of plasticizers for polystyrene and/or acrylic ester resins; and
3. triphenylcarbinol.

2. The composition of claim 1 dispersed or dissolved in a polymeric film-forming binder.

3. The cmposition of claim 1 wherein the free radical source is an organic compound in which at least three halogen atoms other than fluorine are attached to a single carbon atom.

4. The composition of claim 1 wherein the plasticizer is selected from the group consisting of trialkyl- and triaryl-phosphates.

5. The composition of claim 1 wherein the aromatic -OH compound is a polyhydroxyphenol.

6. The composition of claim 1 wherein the color former is selected from the family of the 1,1-bis(p-dialkylaminophenyl)ethylenes.

7. The composition of claim 1 wherein the color former is selected from the group consisting of 1,1-bis(p-dimethylaminophenyl)ethylene and 1,1-bis(p-diethylaminophenyl)ethylene.

8. The composition of claim 1 wherein the color formers are taken from the group of a combination of the leuco triphenylmethane dyes and the dialkylstyrylquinolines.

9. The composition of claim 1 wherein the color former comprises leucocrystal violet and dimethylstyrylquinoline.

10. The composition of claim 1 wherein the color former comprises leuco malachite green and diethylstyrylquinoline.

11. The composition of claim 1 wherein the color formers are taken from the group of a combination of the leuco dihydroanthracenes and the dialkylstyrylquinolines.

* * * * *